US006322455B1

(12) United States Patent
Howey

(10) Patent No.: US 6,322,455 B1
(45) Date of Patent: Nov. 27, 2001

(54) INTERACTIVE GOLF DRIVING RANGE FACILITY

(76) Inventor: Mark Benjamin Howey, 18295 Lake Bend Dr., Jupiter, FL (US) 33458

( * ) Notice: Subject to any disclaimer, the term of this patent is extended or adjusted under 35 U.S.C. 154(b) by 0 days.

(21) Appl. No.: 09/393,367

(22) Filed: Sep. 10, 1999

(51) Int. Cl.[7] ..... A63B 69/36

(52) U.S. Cl. ..... 473/168; 473/131; 473/150; 473/154; 473/167; 273/461

(58) Field of Search ..... 273/245, 317.2, 273/333, 404; 463/3, 5, 54; 473/131, 140, 141, 145, 146, 151, 154, 157, 163, 166–167, 168, 173, 190, 191, 192, 198, 199, 221–226, 238, 407, 409

(56) References Cited

U.S. PATENT DOCUMENTS

| | | | | |
|---|---|---|---|---|
| 3,310,310 | * | 3/1967 | McKee | 273/176 |
| 3,559,996 | * | 2/1971 | Hopp | 273/176 |
| 3,599,981 | | 8/1971 | Zausmer . | |
| 3,727,069 | | 4/1973 | Crittenden, Jr. . | |
| 3,990,708 | | 11/1976 | Ingwersen . | |
| 4,045,023 | | 8/1977 | Heffley, Jr. . | |
| 4,086,630 | * | 4/1978 | Speiser et al. | 364/410 |
| 4,141,557 | | 2/1979 | Ingwersen . | |
| 4,652,121 | | 3/1987 | Ito et al. . | |
| 4,770,527 | | 9/1988 | Park . | |
| 4,949,972 | | 8/1990 | Goodwin et al. . | |
| 5,024,441 | | 6/1991 | Rousseau . | |
| 5,269,519 | * | 12/1993 | Malone | 273/85 |
| 5,303,924 | * | 4/1994 | Kluttz | 273/181 |
| 5,370,389 | | 12/1994 | Reising . | |
| 5,419,565 | | 5/1995 | Gordon et al. . | |
| 5,481,355 | | 1/1996 | Iijima et al. . | |
| 5,501,462 | * | 3/1996 | Shih | 273/176 |
| 5,516,113 | | 5/1996 | Hodge . | |
| 5,562,285 | * | 10/1996 | Anfinsen et al. | 473/155 |
| 5,568,250 | | 10/1996 | Nishiyama et al. . | |
| 5,626,526 | | 5/1997 | Pao et al. . | |
| 6,012,987 | * | 1/2000 | Nation | 473/156 |

* cited by examiner

*Primary Examiner*—Jessica J. Harrison
*Assistant Examiner*—Alex F. R. P. Rada, II
(74) *Attorney, Agent, or Firm*—Stearns, Weaver, Miller, Weissler, Alhadeff & Sitterson, P.A.

(57) ABSTRACT

An interactive golf driving range and practice facility including an apparatus and method for detecting the down range impact of golf balls, for processing information derived from the impact data, for providing the golfer with statistical information, and for providing the golfer with feedback relating to accuracy and distance and for displaying useful information while presenting the golfer with a variety of skill challenging, instructional and competitive options. The present invention further provides for selective video recording and playback of the golfer's swing for instructional use and for improving swing mechanics.

9 Claims, 8 Drawing Sheets

INTERACTIVE GOLF DRIVING RANGE FACILITY

BACKGROUND OF THE INVENTION

1. Field of the Invention

The present invention relates generally to the game of golf, and more particularly to improvements in golf driving range facilities. In particular the present invention relates to the combination of a sensing apparatus for detecting the down range impact of golf balls, either actual or projected, computer apparatus for processing information derived from the impact data, and output apparatus for providing the golfer with feedback relating to accuracy, distance, consistency and for displaying useful information while presenting the golfer with a variety of skill challenging, instructional and competitive options.

2. Description of the Background Art

The game of golf is a popular sport played by millions throughout the world. The sport is enjoyed by men, women and children of all ages and has seemingly universal appeal. While a game of golf is customarily played on a golf course, many players sharpen their skills at various practice facilities.

The most common practice facility is a golf driving range. Golf driving ranges are typically configured with a hitting area, comprising either natural grass or artificial turf, and a landing area or range including various targets such as greens, and yardage markers. Driving ranges allow golfers the opportunity to practice and improve various aspects of their game and provide for practice sessions where golfer's may practice by hitting hundreds of balls in a single session while varying shot and club selection.

While golf driving ranges of the background art provide a basic setting for practice, there are a number of disadvantages present. For example, while most driving ranges provide targets for golfers to aim at to improve accuracy, factors such as visibility, light conditions, and distance often make it difficult for the golfer to accurately judge the accuracy and true distance of the golfer's shots. Determining accuracy becomes increasingly difficult when the golfer is sending balls hundreds of yards down range, particularly when the golfer is practicing at night on a dimly lighted driving range. Accordingly, golf driving ranges could be significantly improved by the addition of features that would provide a golfer with accurate feedback regarding shot accuracy and distance. Another disadvantage present in golf driving ranges of the background art is the lack of variety offered to the golfer by an expansive range that does not offer the opportunity for specific skills challenges and means for keeping score. Accordingly, golf driving ranges could be improved by the addition of features that would enable golfers to select a specific target and accurately track shots directed to the selected target. In addition, golf driving ranges could be improved by features that would allow the golfer to select and play a simulated round including, for example, tee shots followed by fairway and chipping shots, either alone or in competition with fellow golfers. Such improvements would preferably include means for automatically keeping each golfer's score during the simulated round.

The background art has revealed several attempts to improve golf driving ranges, each of which includes a number of undesirable characteristics. For example, U.S. Pat. No. 3,599,981, issued to Zausmer, discloses a system for determining the distance a golf ball has traveled from a tee and the distance a golf ball is lying from the middle of a green. Much like conventional driving range designs, the Zausmer system relies on a series of markers placed in the fairway and requires that the golfer estimate the distance of his ball.

U.S. Pat. Nos. 3,990,708, issued to Ingwersen, discloses an indoor/outdoor golf facility including outdoor mechanized greens constructed to retrieve a golf ball through a position indicating mechanism. The mechanized greens disclosed by Ingwersen are raised from the ground and include downwardly sloping segment surfaces, netting material, and golf ball activated switches. The Ingwersen system also requires that the golfer estimate the distance of his tee shot. U.S. Pat. No. 4,141,557, also issued to Ingwersen, discloses a simulated golf green comprising a segmented target. Use of segmented target areas, however, does not provide an accurate indication of the landing location of golf balls.

U.S. Pat. No. 4,045,023, issued to Heffley, Jr., discloses an all-weather driving range including a scoreboard and impact responsive devices by which the scoreboard registers a score in response to an impact on the target. Heffley, Jr. also discloses a vertical screen divided into sections and electronically configured such that yardage is estimated by detection of impacts on the various sections of the screen.

U.S. Pat. No. 5,024,441, issued to Rousseau, discloses a golf course simulator. Rousseau relies on a vertical target incorporating an impact detector matrix and a computer to determine the point of arrival of the ball.

U.S. Pat. No. 5,370,389, issued to Reising, discloses a golfing range including various targets and coded balls. Target greens located at varying distances from the teeing area having sloping surfaces leading to a hole located at the lowest point of the surface. After a ball rolls into the hole of the green, a sensor scans the ball and identifies from which tee the ball came. Each green can have a different point value depending upon the difficulty of the golf shot required to land on that green. After the ball rolls into the hole of the green, a sensor scans the ball and identifies from which tee the ball came. A scoring device then registers a score at a corresponding tee.

The references of the background art fail to overcome the disadvantages present in golf driving ranges and fail to disclose or suggest suitable apparatus or methods for use in a golf driving range setting. Accordingly, there exists a need for a system and method for providing a golf driving range that provides a golfer with a wide variety of games of skill while tracking actual ball flight accuracy and distance, and providing instructional information such as video swing analysis.

BRIEF SUMMARY OF THE INVENTION

The present invention overcomes many of the disadvantages present in the background art by providing a system, including an apparatus and method, for determining the down range impact of golf balls, for processing information derived from the impact data, for providing the golfer with statistical information, and for providing the golfer with feedback relating to consistency, accuracy, and distance and for displaying useful information while presenting the golfer with a variety of skill challenging, instructional and competitive features and options. The present invention further provides for selective video recording and playback of the golfer's swing for instructional use and for improving swing mechanics.

A system according to the present invention includes a hitting area, a range, and electronic hardware and software. According to the present invention, a golf driving range is adapted with golf ball sensing apparatus for determining the down range impact point of golf balls struck from the hitting area. In a preferred embodiment, the sensing apparatus comprises golf ball impact sensors embedded in a mat-like structure installed in covering relation over the range surface. In an alternate embodiment the sensing apparatus may lie on top of the range surface. The sensing apparatus comprises a means for detecting the impact of golf balls on the mat-like surface. The sensing mat of the preferred embodiment is preferably: durable to withstand repeated impacts, resilient to return to its original state shortly after each impact; elastic such that deformation of the mat under impact transfers relative motion to the sensing apparatus contained within the mat; economical such that large tracts of range may be covered; and weather and water resistant. In an alternate embodiment the sensing apparatus may comprise a golf ball trajectory sensor capable of determining the launch angle and velocity of a golf ball.

The sensing apparatus is electronically connected to a computer processor for calculating and processing golf ball impact data, for receiving input commands from the user, and for providing output in a variety of forms. The computer system preferably includes a video display located at the hitting area and at least one video camera trained on the hitting area for capturing digital images of the golfer while executing the golf swing. The system disclosed herein provides a variety of practice options which enable multiple golfers/users: (1) to play a simulated game of golf, including a mix of long and short shots directed to various target areas; (2) to improve accuracy, distance control, and consistency, by hitting multiple shots at a given target area; (3) to improve accuracy, distance control, and consistency with a selected club used to hit multiple shots; (4) to record and playback of recorded video images for analyzing swing mechanics; and (5) to receive instructional advice for correcting faulty swing mechanics.

Accordingly it is an object of the present invention to improve golf driving ranges to enhance the experience of practicing the game of golf.

Yet another object of the present invention is to improve golf driving ranges by providing sensing apparatus for determining the down range landing locations of golf balls struck from a hitting area and to graphically display the landing locations, along with distance and accuracy information, in real time to the golfer.

Still another object of the present invention is to provide an apparatus and method for allowing multiple golfer's to play and score a simulated round of golf while never leaving a common hitting area.

Another object of the present invention is to provide an apparatus and method for providing golfers with a variety of skill enhancing practice options, wherein shot distance and accuracy are accurately determined, while allowing each golfer to selectively record, store and playback video images of his or her swing.

Yet another object of the present invention is to provide an apparatus and method for allowing a golfer to download various statistical information, instructional information and/or video images for later use, archival, and reference.

DETAILED DESCRIPTION OF THE INVENTION

Figure 1:
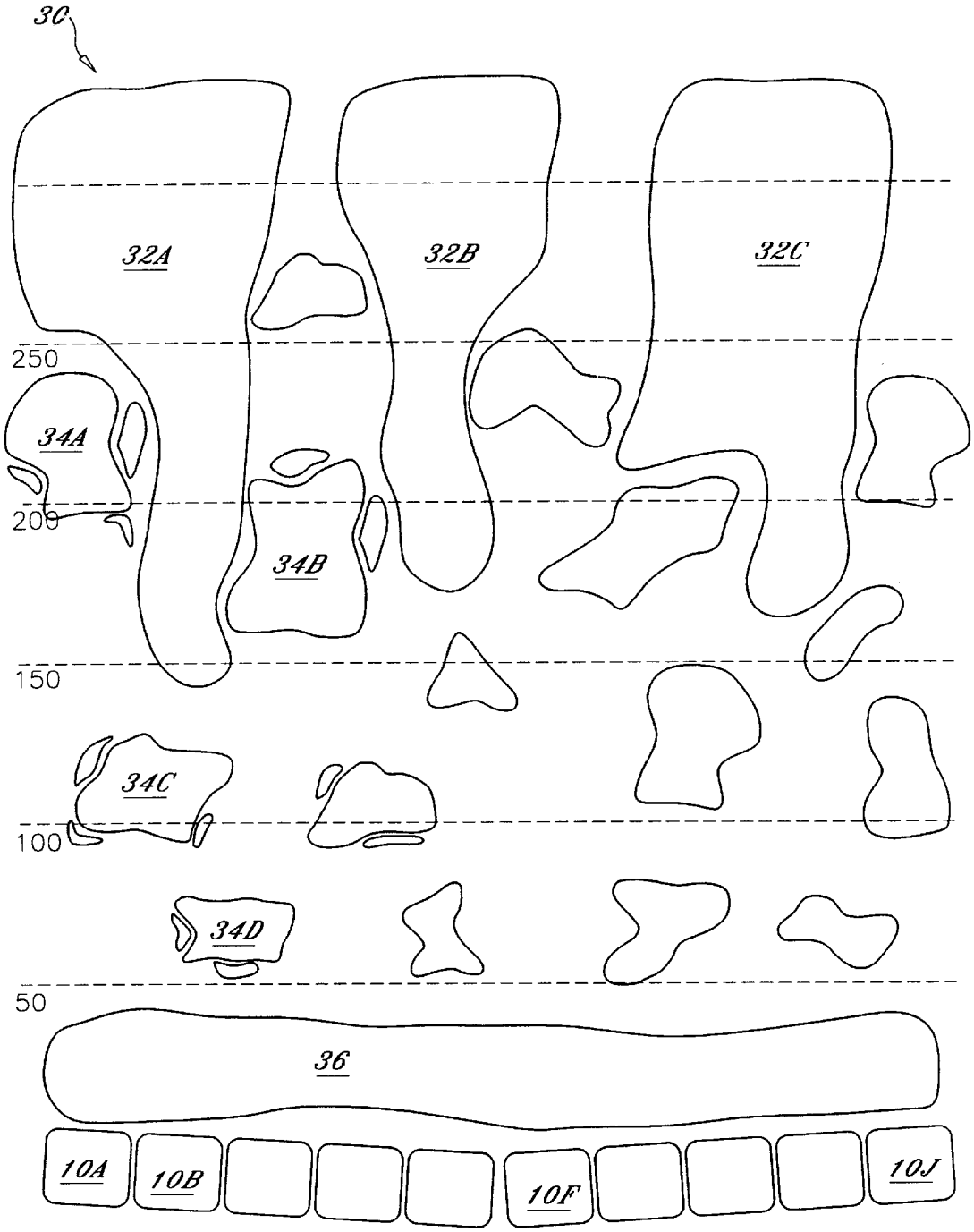
FIG. 1 is a plan view of a golf driving range layout suitable for use with the present invention.

With reference now to the drawings there is disclosed a system, including an apparatus and method, for use in practicing the game of golf and for providing an improved driving range facility. FIG. 1 shows a plan view of a golf driving range facility configured according one embodiment of the present invention. The facility generally includes a plurality of hitting areas, referenced as 10A–10J, and an expansive range providing a landing area 30 and including a variety of discrete target areas 32, 34, 36.

Figure 2:
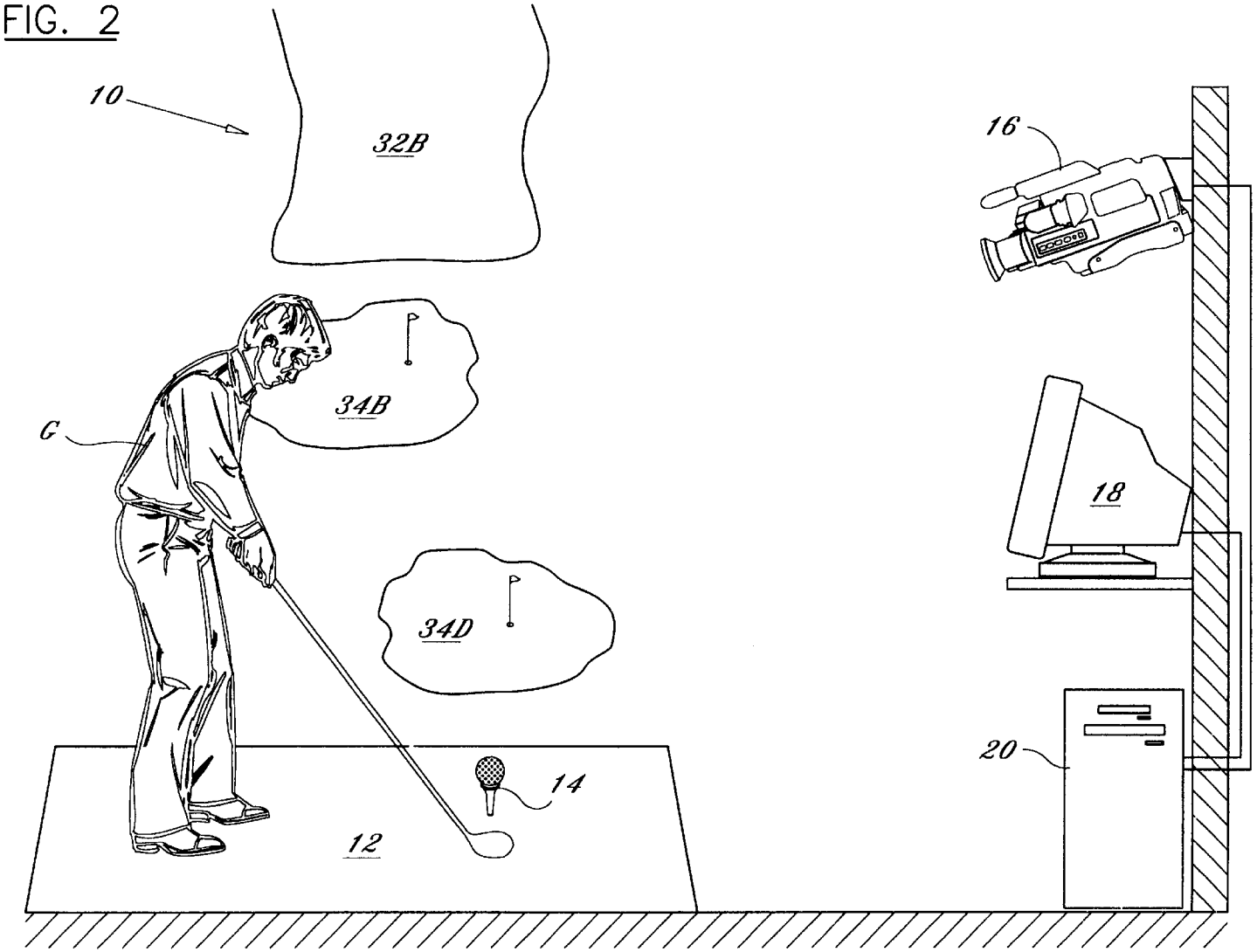
FIG. 2 is a perspective view of a hitting area showing a golfer and apparatus of the invention.

As best seen in FIG. 2, hitting areas 10 preferably include an artificial turf mat hitting surface 12, which may include a permanent rubber tee 14, from which a golfer, referenced as "G", is able to hit golf balls with conventional golf clubs. Each hitting area 10 may also include at least one video camera 16, suitably mounted, angled and otherwise positioned so as to be trained and framed on golfer "G" while addressing a golf ball on surface 12. In a preferred embodiment one or more video cameras 16 may be positioned facing the golfer from the front as depicted in FIG. 2 and/or from the side (i.e. off of the golfer's right side aimed down the target line, camera not shown). Other camera positions/locations and/or angles should be considered within the scope of the present invention. Camera(s) 16 is preferably a digital camera capable of capturing both moving images and still images. Hitting area 10 also includes a video display monitor 18, and a computer 20 that is associated therewith, which cooperate to provide graphical display and input/output capabilities as further discussed herein. As should be apparent, computer 20 may be remotely located without departing from the scope of the invention. Video display monitor 18 may also include touch screen input capability for providing input means.

Figure 11:
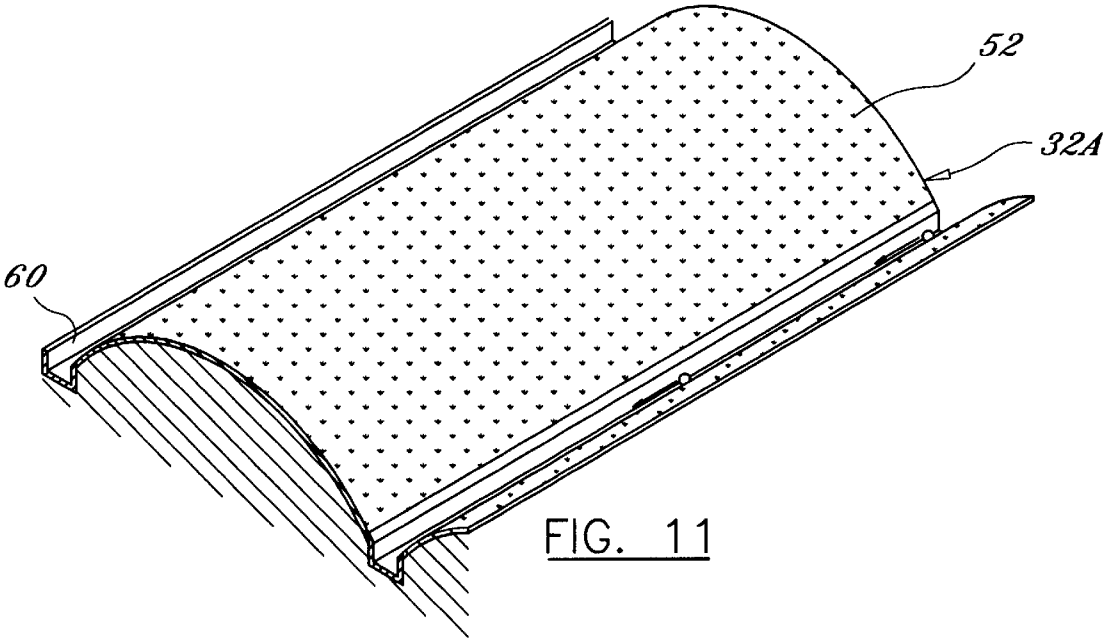
FIG. 11 shows a partial sectional perspective view of a target area having a convexly shaped top surface and golf ball collection gutters on opposing sides thereof.

In the preferred embodiment, target areas 32 simulate golf fairway landing areas, and are thus sized, shaped, and located down range so as to provide golfers at the hitting area with simulated fairway target areas. As best depicted in FIG. 11, each target area, and particularly fairway target areas 32, may define a convex cross-section such that golf balls landing on the target area roll from the target area, under the influence of gravity, to a collection area located in close proximity to the target area. The convexly shaped target areas and corresponding collection areas 60 allow for golf balls accumulating in the collection areas may be periodically collected, or automatically conveyed, either by gravity, manual collection, or powered conveyer, back to hitting areas 10. Other suitable surface shapes, including concave and/or sloped are considered within the scope of the present invention. Furthermore, to the extent that substantially horizontal surfaces are used, golf balls may be removed therefrom by a suitable ball removal apparatus. A suitable ball removal apparatus comprises a system for sweeping balls from the surface. Such a system may comprise a sweeping member disposed parallel and substantially adjacent to said surface, which sweeping member may be connected to a mechanical actuator for selectively causing the sweeping member to pass across the surface thereby sweeping any golf balls thereon to a collection area.

Target areas 34 simulate golf greens, and are thus sized and shaped to generally appear as conventional greens, and are positioned various distances down range so as to provide golfers at the hitting area with a number of target greens at various distances/yardages. Each target area 34 may include a plurality of flag sticks strategically positioned thereon, i.e. front, back, center, left, right, etc. Similarly, target areas 36 simulate chipping target areas and are positioned closest to hitting areas 10, for providing targets to which golfers may hit relatively short chip shots. In addition, target areas 36 provide a putting surface upon which golfer's may putt. Accordingly, target areas 36 include cups spaced at varying distances from the hitting areas to provide a golfer, standing at a designated putting position, with putts of varying lengths. As discussed herein below, the length of any given putt will depend on the distance remaining to the hole after the golfer's last shot. For example, if the golfer's approach shot is ten feet from the hole, then the golfer would putt to a cup spaced ten feet from the putting location.

Figure 12:
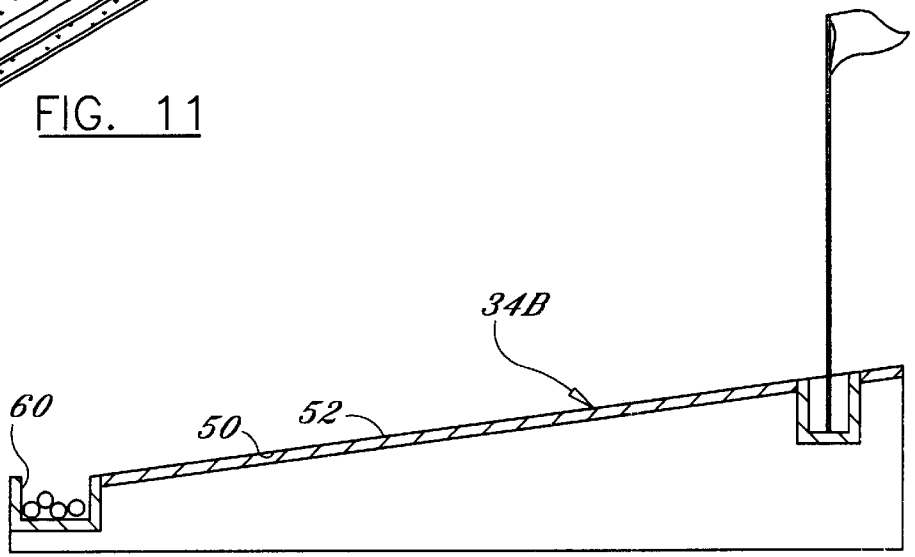
FIG. 12 shows a side sectional view of a target area having a sloped top surface and a golf ball collection area.

As shown in FIGS. 11 and 12, target areas 34 and 36 may have convex, concave, dome-shaped, or sloped top surfaces for allowing golf balls to roll off, under the influence of gravity, to one or more nearby collection areas. Golf balls collecting in said collection areas may be automatically returned to the hitting areas, either by mechanical conveyer, manual collection, or under the influence of gravity. The range areas surrounding each of the target areas 32, 34, and 36 may include simulated golf hazards, such as sand traps, water hazards and the like.

Figure 3:
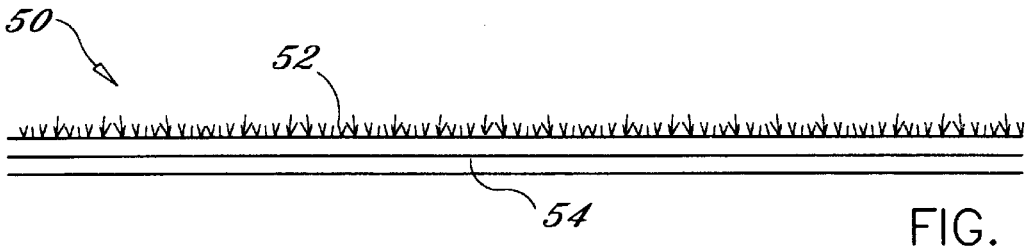
FIG. 3 is a cross sectional view of one embodiment of an impact sensing apparatus for detecting golf ball impacts.
Figure 4:
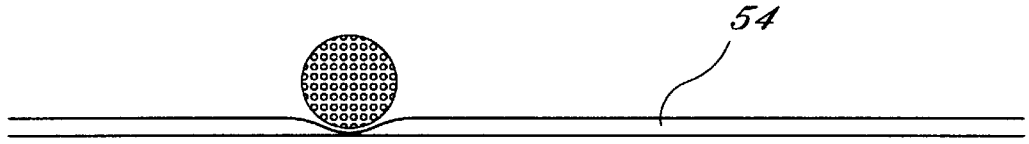
FIG. 4 is a cross sectional view of the impact sensing apparatus shown in FIG. 3 with a golf ball impacting thereon.
Figure 5:
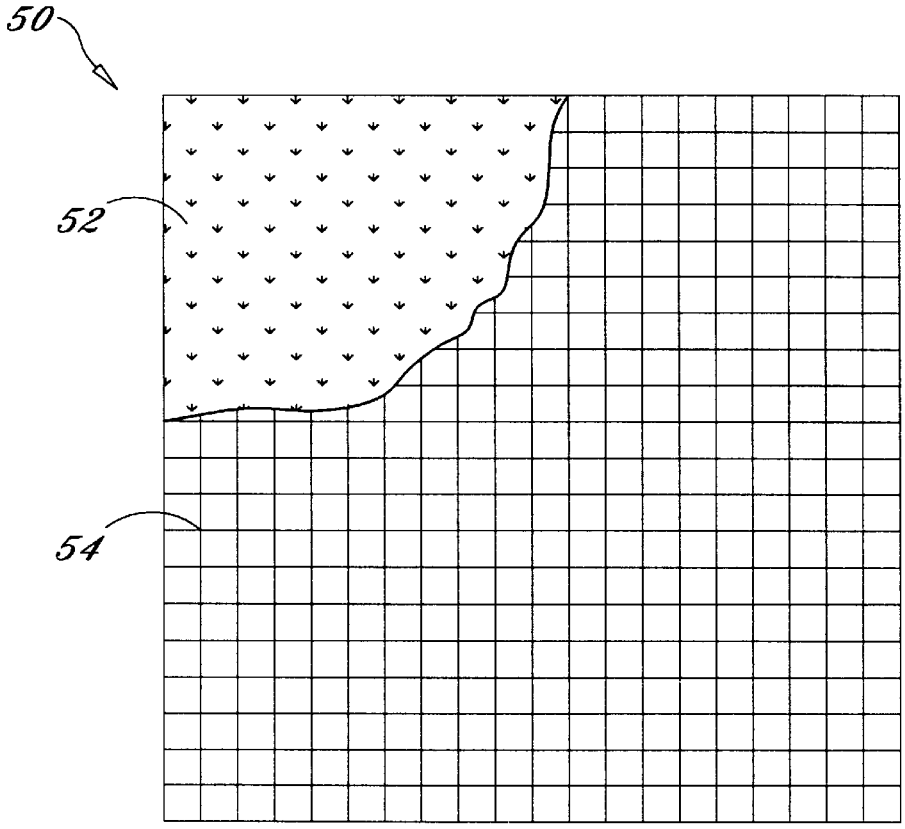
FIG. 5 is a top plan view of a mat-like structure containing the impact sensing apparatus shown in FIGS. 3 and 4.

According to a preferred embodiment of the present invention, the range 30, and particularly target areas 32, 34, and 36, include golf ball impact sensing devices for sensing the location where a golf ball impacts the ground, particularly the impact locations on target areas 32, 34, and 36. In a preferred embodiment, the sensing apparatus comprises a mat-like structure installed in covering relation over the range surface. As shown in FIGS. 3, 4, and 5, the impact sensing apparatus may, in one embodiment, comprise a composite structure, generally referenced as 50, incorporating an electromechanical detection system for measuring a point of impact on the mat. Another suitable sensing apparatus is disclosed in U.S. Pat. No. 5,419,565, which is incorporated herein by reference, wherein an impact detection system is disclosed comprising a wire or plastic grid that is instrumented to measure changes in stress in the individual grid elements that occur when a golf ball lands on the mat. A suitable structure for such a mat includes a composite layered configuration including top and bottom layers, 52 and 54 respectively. Top layer 52 preferably comprises a layer including an artificial turf surface to have the outward appearance of grass, and bottom layer 54 preferably comprises a grid formed of wires or the like which function to stress a network of piezo ceramic elements thereby generating an electrical signal. Suitable electronic circuitry is used to convert signals generated by golf ball impact to a processor and display located at the hitting area.

In another suitable sensing device, the mat-like structure may have top and bottom electrically conducting layers that deflect upon impact thereby coming into contact, like a switch, at the point of impact. The electrical contact generates a signal proportional to and corresponding with the distance from the hitting area. The generated signal may have a particular voltage, current, impedance, and/or resistance level, to identify a particular region of the range area corresponding to predetermined locations.

Upon impact the video display located proximal the hitting area preferably indicates the location with an icon, which icon may flash or change color (e.g. green, yellow, red) for a predetermined period of time thereby allowing the golfer to provide an input command to accept the flashing icon as that golfer's ball, as opposed to the ball of another golfer.

The impact detecting mat is preferably: durable to withstand repeated impacts, resilient to return to its original state shortly after each impact; elastic such that deformation of the mat under impact transfers relative motion to the sensing apparatus contained within the mat; economical such that large tracts of range may be covered; and weather and water resistant.

Figure 10:
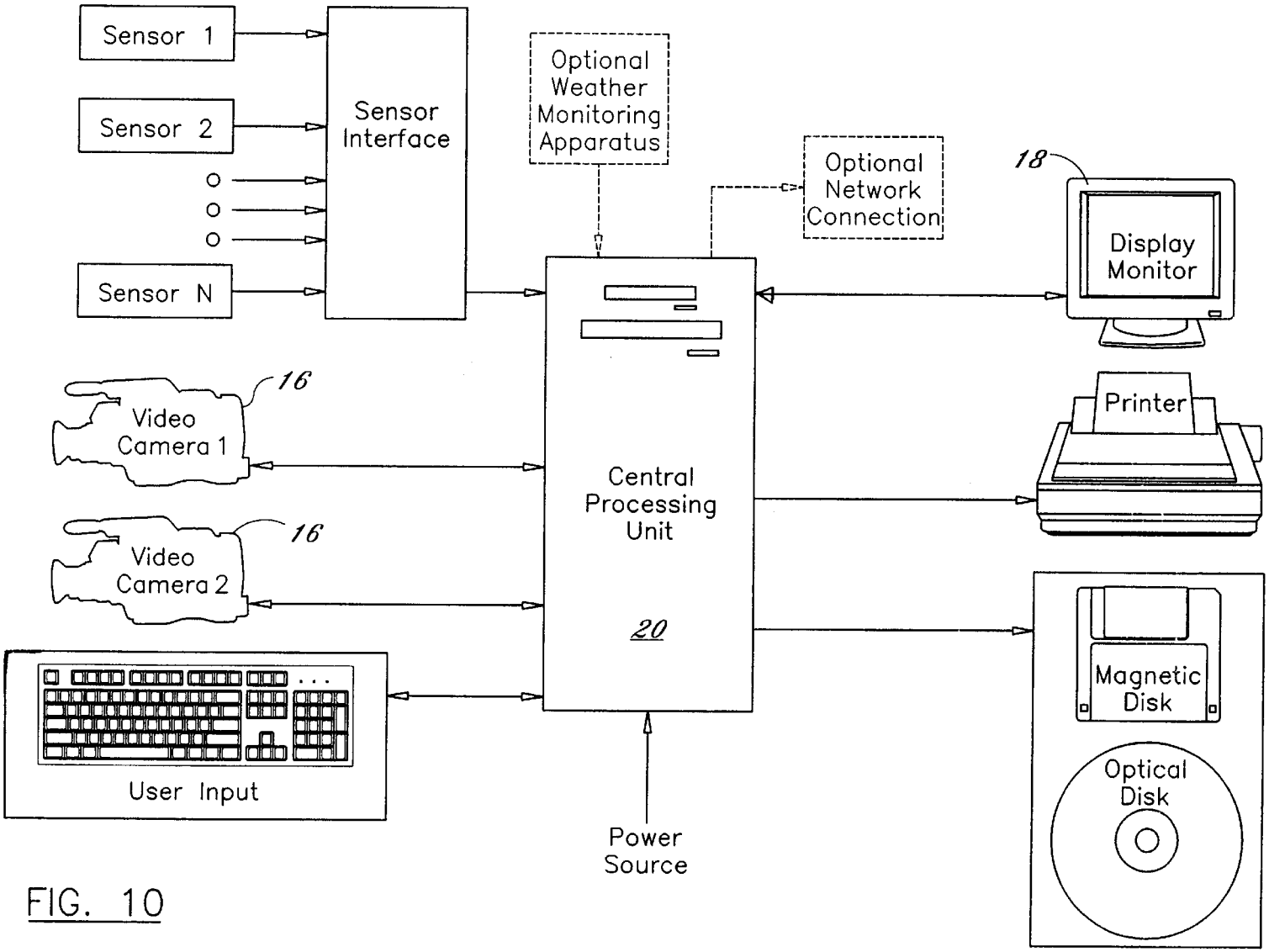
FIG. 10 is a block diagram of a hardware configuration according to the present invention.

While it is believed that the mat-like impact detection means described herein provides a preferred apparatus for detecting the impact of golf balls landing down range, there exist a number of alternate apparatus that may be substituted therefor without departing from the scope of the present invention. Included among such alternate apparatus are devices that measure the trajectory and velocity of the ball leaving the hitting area, and based on the data obtained calculate an estimated down range impact point. Examples of such alternate apparatus include U.S. Pat. No. 5,626,526, issued to Pao et al., U.S. Pat. No. 5,568,250, issued to Nishiyama et al., U.S. Pat. No. 4,949,972 issued to Goodwin et al., and U.S. Pat. No. 5,481,355 issued to Iijima et al., each of which is incorporated herein by reference. Such devices may be used as alternate golf ball sensors to predict the impact location of golf balls hit from the hitting area by determining each ball's in flight velocity and trajectory (i.e. launch angle and angular deviation from target line) and providing the velocity and trajectory data to a computer for calculation of the projected impact location. In this alternate configuration the sensing apparatus is preferably located in generally close proximity to the hitting area, disposed between the hitting surface and the down range targets. One known disadvantage with such an apparatus, however, is an inherent inaccuracy that may result from the failure of the apparatus to account for atmospheric conditions, namely wind. The affect of wind on the trajectory of golf balls may, however, be taken into account by including a weather monitoring apparatus as shown in FIG. 10, including an anemometer and vane system, for detecting wind velocity and direction, which data may be provided as input and incorporated into the appropriate projectile calculations to determine the projected deviation of golf balls from an otherwise windless trajectory. Another known disadvantage of trajectory/velocity sensing involves trajectory deviations caused by spin imparted on the golf ball (i.e. hook or slice spin). Accordingly, the accuracy of trajectory/velocity sensing may be further improved by the addition of means for sensing golf ball spin rate and direction. Such information would be provided as input for use in calculating the landing location.

It should be apparent that other such devices may be suitable for use with the present invention. For example, optical and/or infrared sensors positioned very close to the target area surface and/or high above the target area surface may be used to detect golf ball movement and communicate the location data to the computer. In yet another embodiment, beam sensors (i.e. transmitters and receivers) may be used to form a beam grid with beam paths above the surface of the target areas at a height that is less than the diameter of a golf ball (i.e. approximately 1.0 inch) such that a golf ball disposed between a particular transmitter/receiver combination will break the beam thereby indicating the exact position of the golf ball.

As best seen in FIG. 10, in any sensing configuration the sensing apparatus 50 is electrically connected to computer 20 which is configured receive golf ball impact data, either actual or projected, according to data obtained from the sensing apparatus. The impact data provides the golfer with precise feedback identifying the landing spot of each shot. The impact data may be displayed to the golfer at the hitting area in a variety of output formats including a display 8, or via an audible output using voice synthesis technology.

FIG. 10 depicts a block diagram of a system according to the present invention. As seen in FIG. 10, a plurality of sensors are electrically connected to a sensor interface. As disclosed herein, the sensors may be: (1) impact sensors placed in covering relation with the target areas for sensing the physical impact, and particularly the location of impact; (2) trajectory and velocity sensing apparatus; or (3) any other suitable means for sensing the location of golf balls, including infrared sensors, light beam sensors, optical sensors and the like. The sensing apparatus, and optional weather monitoring apparatus, are electrically connected to a central processing unit for providing input relative to the golf ball impact location, either actual or projected. In addition, digital imaging cameras (shown as video cameras 1 and 2) and an input device are each electrically connected to the central processing unit. The central processing unit is also connected to output hardware including a monitor (for displaying information and graphics), a printer (for producing statistical and instructional output in a printed hard copy format), and optical and/or magnetic disk drives (for producing statistical and instructional output in stored format). The central processing unit is preferably powered by an A.C. power source that may include an uninterruptable power supply ("UPS"). An optional network connection allows for networking of multiple central processing units for coordinating local and/or remote activities.

SOFTWARE DRIVEN OPTIONS

Figure 9:
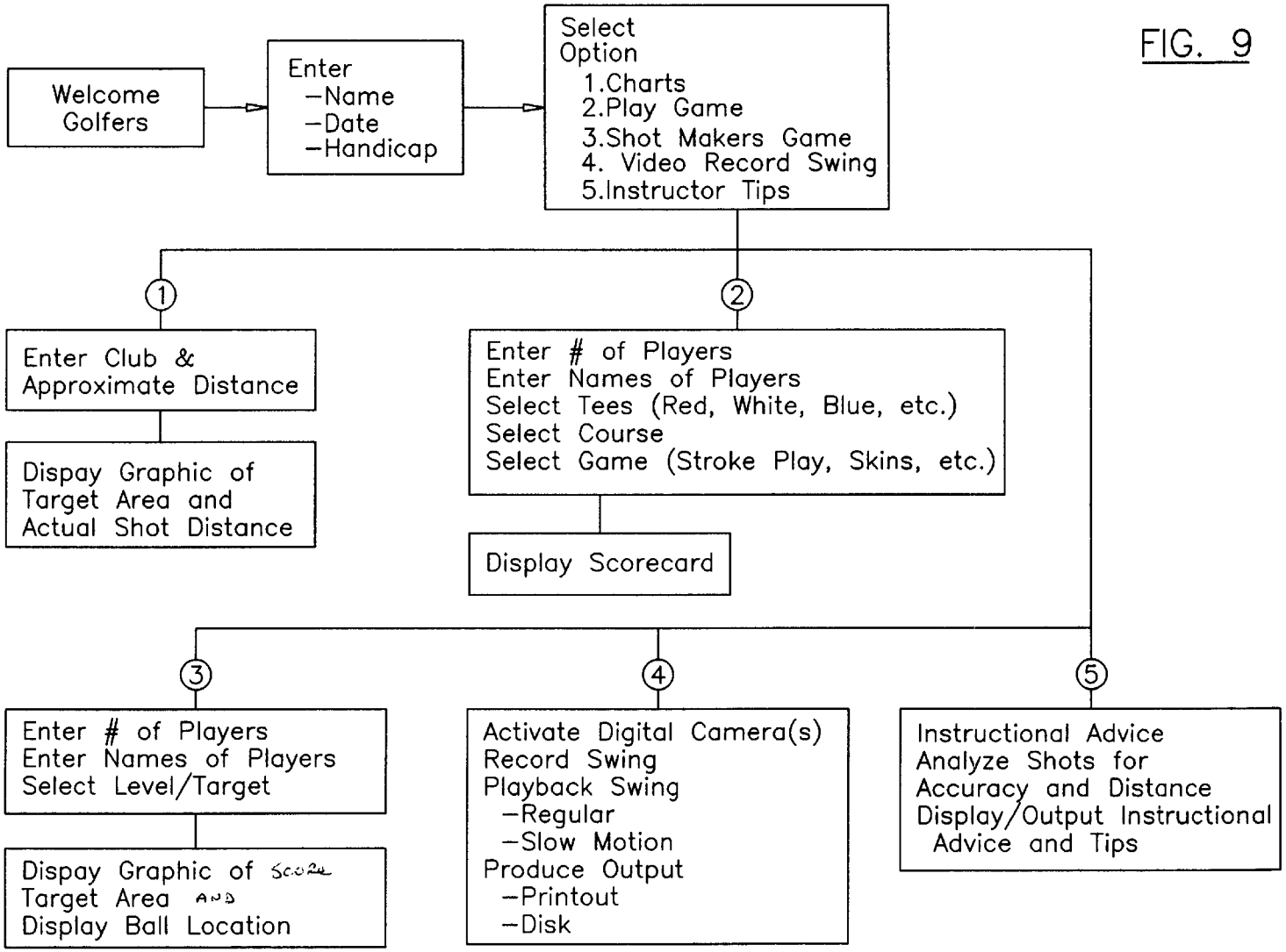
FIG. 9 is a flow chart illustrating interactive options available and input prompts for display on a video monitor of the present invention.

In the preferred embodiment computer software provides the golfer with a variety of pre-programmed options including the ability to play a simulated game of golf, to play one or more target specific games, to activate video camera 16 for selectively recording the golfer's swing, to display scores, target graphics, statistics, video playback of recorded swings, and instructional information. As best illustrated in the flow chart shown in FIG. 9, video display monitor 18 prompts the golfer to select which features and/or options to activate at any given time. For example, the software routine may initially cause video monitor 18 to display a main menu screen that welcomes the golfer to the facility, provide the golfer(s) with basic information regarding the options available, and prompt the golfer(s) to input information, such as the number of players, and to select the type of game and/or activity that the golfer wishes to engage.

PLAYING A SIMULATED ROUND OF GOLF

Figure 6:
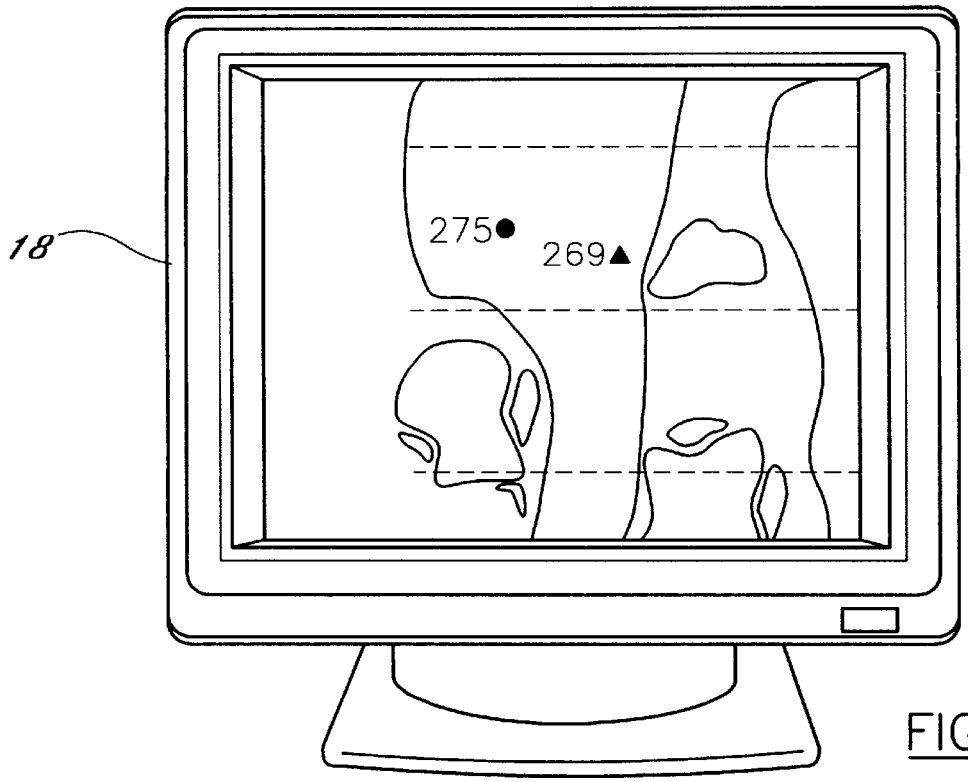
FIG. 6 is a video display showing a graphic representation of a fairway target area and golf ball impact locations.
Figure 7:
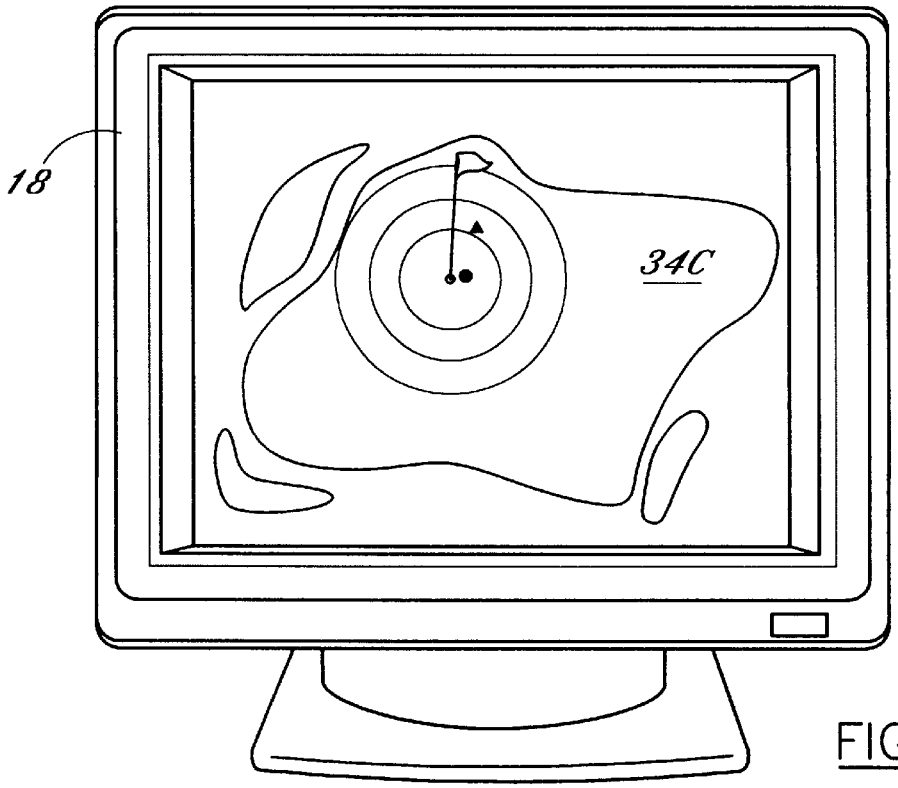
FIG. 7 is a video display showing a graphic representation of a green target area and the location of golf balls that have impacted thereon.

One of the primary activities contemplated by the present invention includes playing a simulated game of golf wherein alternating fairway and green type targets are designated such that the golfer is required to hit various alternating long and short shots. The apparatus described herein functions to simulate a game of golf wherein one or more golfers compete as if playing an actual round of golf. In this mode of operation the golfers enter hitting area 10, select the "play a game of golf" option whereafter the video display will identify or highlight specific target areas 32–36 corresponding to the simulated holes (i.e. par 3, par 4 or par 5). For example, if the first hole of the simulated round is a par 4, the display may indicate that the golfer is to drive his or her ball to target area 32A. Impact sensing apparatus 50 at target area 32A is used to detect the spot down range where the golfer's ball actually lands, and as best shown in FIG. 6, the landing spots are graphically displayed on video monitor 18 along with other information relating to distance and accuracy (i.e. on or off fairway, left, right, center etc.). The software would also calculate the approach shot length by subtracting the length of the first shot from the total hole length. Accordingly, once the approach shot length is calculated, the golfer is prompted to hit an approach shot to a specified down range target such as target green 34A. As with the previous shot, impact sensors on and around target green 34A are used to detect the spot where the golfer's ball actually lands which spot is graphically displayed on video monitor 18 as shown in FIG. 7. If the golfer is not successful in landing the ball on the green an appropriate chip/pitch shot to target area 36 would be required for the next shot. Once the golfer has landed his or her ball on the putting green, the golfer may complete the hole by actually putting on an artificial putting surface in close proximity to the hitting area. In the preferred embodiment target area 36 provides the golfer with a plurality of putting cups, each cup spaced a given distance from a designated putting line so that the golfer has an opportunity to putt the golf ball a distance corresponding to the distance his or her last shot remains from the simulated hole. As should be apparent, an entire round of golf may be played in a similar manner while the hardware and software described herein allow each shot to be recorded and a score to be tracked and displayed. It should be noted, that other features of the present invention, such as video swing recording using video camera 16 may be selectively activated at any point during the simulated round.

TARGET GAMES

Figure 8:
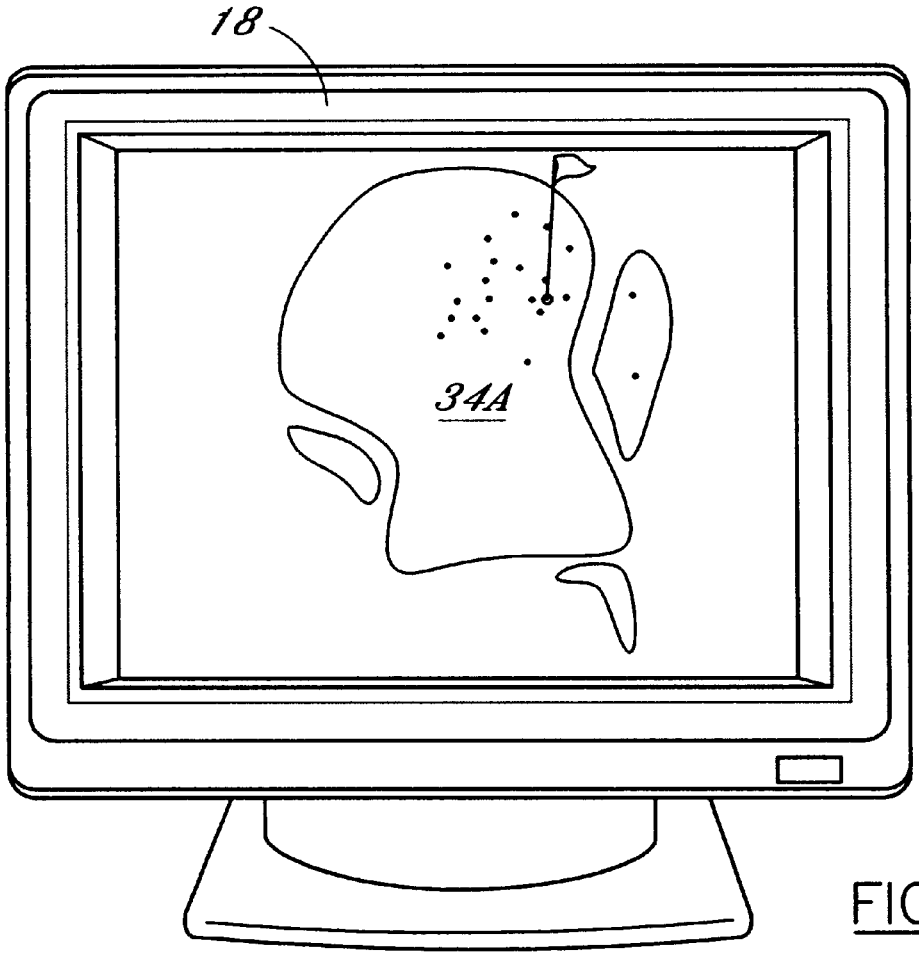
FIG. 8 is an alternate video display showing the impact locations of a plurality of golf balls on a green target area.

As should be apparent, an improved driving range according to the present invention allows other types of skills testing/challenging games. For example, FIG. 8 depicts a video display for a target game wherein the golfers hit multiple shots at a given target area, such as a green, provide bulls-eye type games for practicing short and mid-iron approach shots. Thus, rather than playing the simulated game of golf described herein above, the golfer may select the "Shot Maker's Game" option from the main menu, whereafter the system allows the golfer to select a target area at a golfer selected distance, or the system would select an available target area within a distance range specified by the golfer, target area 34C for example. Once the target area has been determined video monitor 18 displays a realistic graphic representation of target area 34C and golfers can compete against one another by hitting shots toward the target area. As shots land on or around the target area 34C the golf ball impact sensing apparatus 50 registers each impact which is provided as input to computer 20 such that each shot could be tracked and scores displayed. Each impact may be graphically represented as an icon on the target graphic to indicate where the ball landed relative to the target. Player-specific icons may be used to allow each player to determine his shots from those of his competitors. A suitable point system will award a higher score to shots landing close to the target and a lower score for shots landing far from the target.

The present invention further includes an option for determining the accuracy, distance, and consistency of shots hit with a user-selected club. This mode of operation is initially presented as a main menu option and is activated by the golfer by an input command. Upon activation the system will either allow the golfer to select a particular club (i.e. 7 iron) and enter the approximate distance (i.e. 160 yards) that balls struck with the selected club are expected to travel. An appropriate target and/or target line is selected and the golfer then proceeds to hit a number of golf balls down the target line using the selected club. As the golfer's shots land down range, impact sensors in the landing area detect the landing golf balls and each impact is graphically displayed, relative to the target/target line, on the video monitor located at the hitting area. In addition, the actual distance of each shot is calculated and displayed on the monitor so that the golfer is provided with highly accurate yardage information, which information will greatly assist the golfer in selecting the proper club during future rounds of golf. Furthermore, the graphical display of each shot's downrange impact relative to the target line provides the golfer with useful information of the accuracy of the shots.

VIDEO SWING ANALYSIS

Yet another option provided by the present invention, either alone or in combination with the other options discussed herein, relates to video swing analysis. This option allows the golfer to selectively activate one or more video cameras mounted at the hitting area for the purpose of recording the golfer's swing. Using this option the golfer is able to selectively record and play back recorded images of the golfer striking golf balls so that the golfer and/or an instructor may analyze swing mechanics and make proper swing adjustments. As should be apparent, this feature, when combined with other operational aspects of the present invention such the target games, provides the golfer with all of the information necessary, namely swing mechanics, shot accuracy, and distance, for the golfer to improve his or her game.

INSTRUCTIONAL ADVICE

Yet another aspect of the invention includes providing the golfer with instructional tips, which instructional tips may be stored on computer 20 and selectively produced as output, either on display 18 or by printout or by downloading to computer disk. In a preferred embodiment, computer software will generate appropriate instructional tips based on the golfer's tendencies as indicated by the accuracy of the golfer's shots as determined by the impacts sensed. Furthermore, the present invention contemplates that various other information may be produced as output, either in print out form or on magnetic or optical disk, including video or still images of the golfer's swing and/or statistical and score information compiled during a practice session, or portion thereof, for use in charting the golfer's skill level during the practice session and progress over time.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An interactive golf practice facility comprising:

a plurality of hitting areas, each hitting area including at least one generally horizontal planar hitting surface from which a golfer hits golf balls;

a landing area including at least one fairway target area and at least one green target area, each of said target areas spaced from each of said plurality of hitting areas;

an impact sensing mat generally horizontally covering each of said at least one fairway target area and said at least one green target area for determining the actual impact location of golf balls impacting on one of said target areas, said mat incorporating an electro-mechanical impact detection system for measuring the location of golf ball impact on the mat, said impact sensing mat being actuated by direct physical contact between a golf ball and the mat;

computer hardware means electrically connected to said impact sensing mat, said computer hardware means including a central processing unit, input hardware and output hardware, said output hardware including a display monitor located proximal said hitting area;

computer software means for instructing said computer hardware means to process data received from said impact sensing mat, said computer software means capable of receiving impact data from said impact sensing mat and causing said display monitor to display a graphical representation of one of said target areas, said computer software means further capable of processing impact data received from said impact sensing mat and causing said display monitor to display icons representing the location of golf balls on said impact sensing mat.

2. An interactive golf practice facility according to claim 1, wherein said computer software means is responsive to input from a user and input from said impact sensing mat for enabling golfers to play a golf target game wherein a target is selected and a plurality of shots are hit by the golfer to said target, said display means displaying a corresponding graphical representation of said selected target, whereby a golfer hits a plurality of golf balls from one of said hitting areas to said selected target, said impact sensing mat detecting golf ball impacts and providing input to said computer for determining the impact locations of said golf balls, said display means graphically displaying icons corresponding to said impact locations in overlaying relation with said graphical representation of said selected target, said software means calculating accuracy by determining the distance between said selected target and each impact location.

3. An interactive golf practice facility according to claim 1, wherein said computer software means is responsive to input from a user and input from said impact sensing mat for enabling golfers to play a simulated round of golf whereby said software means sequentially designates target areas for eighteen simulated holes, said display means displaying corresponding graphical representations of designated target areas, whereby a golfer hits a golf ball from one of said hitting areas to the designated target area, said impact sensing mat providing input to said computer for determining an impact location of said golf ball, said display means graphically displaying an icon in overlaying relation with the graphical representation of said designated target area, said icon representing the impact location of said golf ball relative to said designated target area, said software means determining the remaining distance to each hole based on the previous shot data and designating a target corresponding to said remaining distance, said target comprising one of a fairway target area, a green target area, or a chipping/putting target area; said computer software means further including a routine for determining a score.

4. An interactive golf practice facility according to claim 3, further including a golf ball collection area disposed adjacent each of said target areas.

5. An interactive golf practice facility according to claim 1, wherein said target areas include a sloped top surface.

6. An interactive golf practice facility according to claim 5, further including means for returning golf balls from said collection area to said hitting areas.

7. An interactive method for practicing golf at a facility having a hitting area from which a golfer hits golf balls, a landing area spaced from the hitting area and including a plurality of target areas toward which the golfer hits golf balls, the driving range facility including an impact sensing mat disposed in generally horizontal covering relation with each tar,et area for determining the actual landing location of golf balls by sensing impacts, electronically connected to a computer processing means having a video display monitor located in proximity to the hitting area, said method including the steps of:

(a) creating a virtual golf course having 18 virtual holes, each hole having a corresponding length measured in yards;

(b) storing said virtual golf course on storage media electronically connected to said computer processing means;

(c) selecting a first target area from said plurality of target areas, said first target area spaced from said hitting area a distance corresponding to a first landing area for a first hole of said virtual golf course, and displaying a graphic representation of said selected target area on a video display monitor located in proximity to said hitting area;

(d) determining, the actual landing impact location of a golf ball hit at said target area from said hitting area relative to said first target area and calculating the distance traveled by said golf ball;

(e) displaying an icon corresponding to the location and distance where said golf ball impacts relative to said first target area on said video display monitor simultaneously with said computer generated representation of said target area for indicating the location of said golf ball relative to said target area;

(f) selecting a second target area from said plurality of target areas, said second target area selected to provide a target area spaced from said hitting area by an approach distance, said approach distance being determined by subtracting the distance traveled by the golf ball on the previous shot from the total hole distance corresponding to said first hole of said virtual golf course, and displaying a graphic representation of said second selected target area on a video display monitor located in proximity to said hitting area;

(g) determining the actual landing impact location of a golf ball hit from said hitting area relative to said second selected target area and calculating the distance traveled by said golf ball;

(h) repeating steps (f) and (g) until the approach distance is less than a predetermined distance whereafter the golfer putts the ball on a putting green into a cup to complete the first hole.

8. An interactive method for practicing golf at a facility according to claim 7, further including the steps of:

(i) repeating steps (c) through (h) for holes two through eighteen respectively.

9. An interactive outdoor golf practice facility comprising:

a hitting area including a generally horizontal planar hitting surface from which a golfer hits golf balls;

a generally horizontal target area, said target area spaced from said hitting area;

an impact sensing mat disposed in covering relation with said target landing area, said impact sensing mat comprising an electromechanical impact detection system actuated by direct contact between a golf ball and the sensing mat, said sensing mat including means for determining the actual impact coordinates of golf balls landing on said target area, said impact sensing mat capable of generating an output signal corresponding to said impact coordinates;

computer hardware electrically connected to said impact sensing mat, said computer hardware including a central processing unit, input hardware and output hardware, said output hardware including a display monitor located proximal said hitting area;

computer software means for instructing said computer hardware means to process data relating to impact coordinates received from said impact sensing mat, said computer software means generating a graphical representation of said target area based on dimensional data corresponding to the size and shape of said impact sensing mat, said computer software means further capable of processing impact data received from said impact sensing mat and causing said display monitor to display icons representing the actual impact location of a golf ball landing on said target area.

* * * * *